US006742994B2

(12) United States Patent
Hironaka et al.

(10) Patent No.: US 6,742,994 B2
(45) Date of Patent: Jun. 1, 2004

(54) RECIPROCATING PUMP WITH MALFUNCTION DETECTING APPARATUS

(75) Inventors: Yoshiaki Hironaka, Saitama (JP); Tadashige Kondo, Tokyo (JP); Kiyoshige Enomoto, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 76 days.

(21) Appl. No.: 10/142,090

(22) Filed: May 9, 2002

(65) Prior Publication Data

US 2002/0168267 A1 Nov. 14, 2002

(30) Foreign Application Priority Data

May 10, 2001 (JP) ..... 2001-139879
Mar. 20, 2002 (JP) ..... 2002-078087

(51) Int. Cl.[7] ..... F04B 49/08

(52) U.S. Cl. ..... 417/63; 417/18; 417/415; 417/417; 417/559; 73/721; 73/727

(58) Field of Search ..... 73/721, 727, 720, 73/726; 417/63, 18, 415, 416, 417, 560, 559, 569

(56) References Cited

U.S. PATENT DOCUMENTS 4,519,254 A * 5/1985 Sonderegger et al. ..... 73/726
4,695,852 A * 9/1987 Scardovi ..... 347/14
4,850,807 A * 7/1989 Frantz ..... 417/63
4,866,989 A * 9/1989 Lawless ..... 73/756
5,176,120 A * 1/1993 Takahashi ..... 123/467
5,836,521 A * 11/1998 Holm et al. ..... 239/584
5,945,605 A * 8/1999 Julian et al. ..... 73/727
6,484,589 B1 * 11/2002 Brock ..... 73/861.18
6,517,330 B2 * 2/2003 Hironaka et al. ..... 417/415

OTHER PUBLICATIONS

U.S. Published Application 2001/0043873, dated Nov. 22, 2001.

* cited by examiner

*Primary Examiner*—Justine R. Yu
*Assistant Examiner*—Emmanuel Sayoc
(74) *Attorney, Agent, or Firm*—Baker Botts LLP

(57) ABSTRACT

A reciprocating pump which is capable of detecting abnormalities in the sucking and discharging of fluid, such as the exhaustion of oil or the clogging of oil on the discharge side, by making use of detecting means which is inexpensive and relatively simple in structure and which can be operated without being detrimentally influenced by the bubbles that may be included in the fluid, while making it possible to minimize the noise generated by external vibrations. In this reciprocating pump, where the sucking and discharging of fluid are effected by making use of a reciprocating member, malfunction-detecting means formed of a piezoelectric element is provided for detecting a pressure fluctuation on a discharge side of the pump, and the pressure fluctuation of fluid being delivered from an discharging port is transmitted via a rigid pressure-receiving member to the piezoelectric element.

9 Claims, 12 Drawing Sheets

FIG.2 (A) Normal
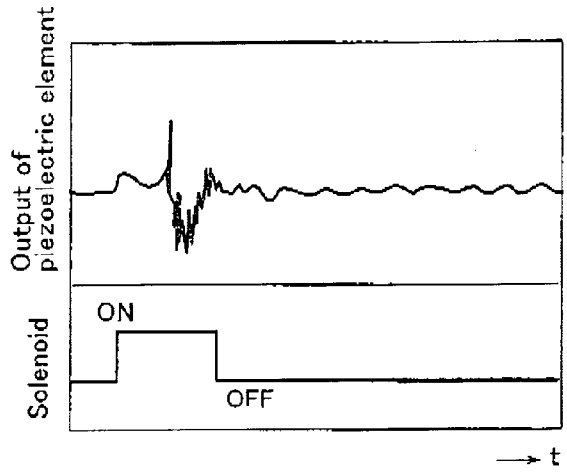
FIG.2 (B) Exhaustion of oil
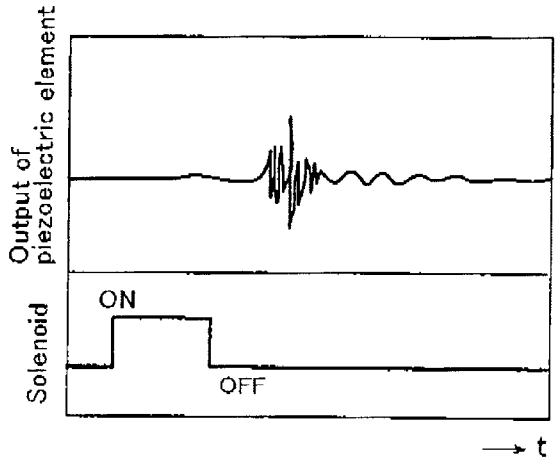
FIG.2 (C) Clogging on discharge side
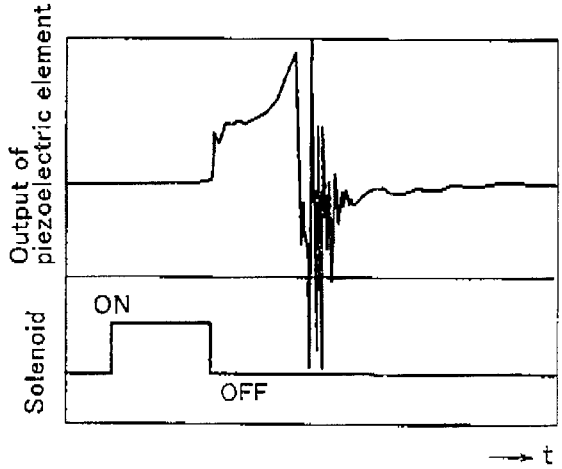

FIG.6(A) Normal
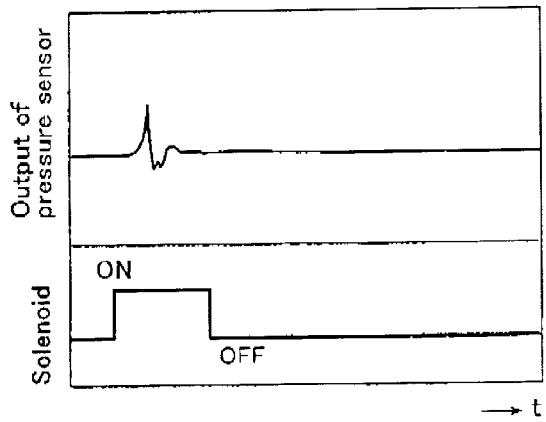
FIG.6(B) Exhaustion of oil
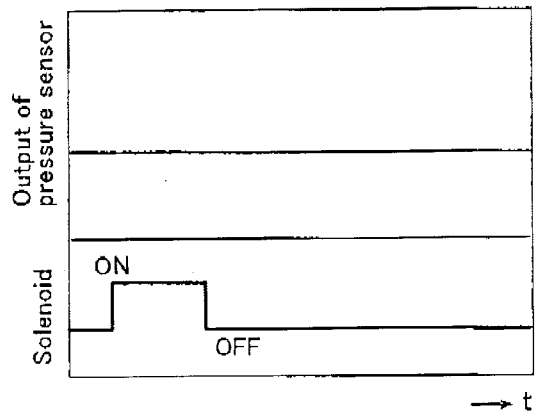
FIG.6(C) Clogging on discharge side
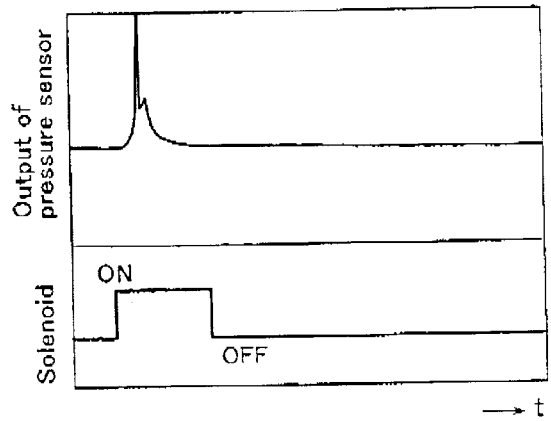

FIG.12(A) Normal
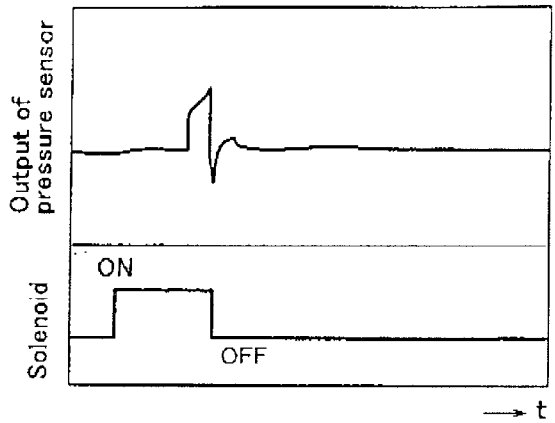
FIG.12(B) Exhaustion of oil
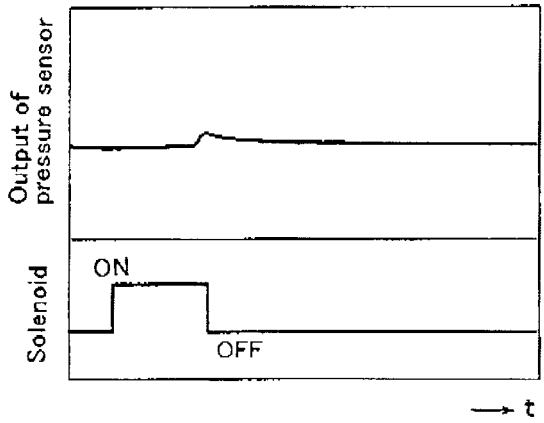
FIG.12(C) Clogging on discharge side
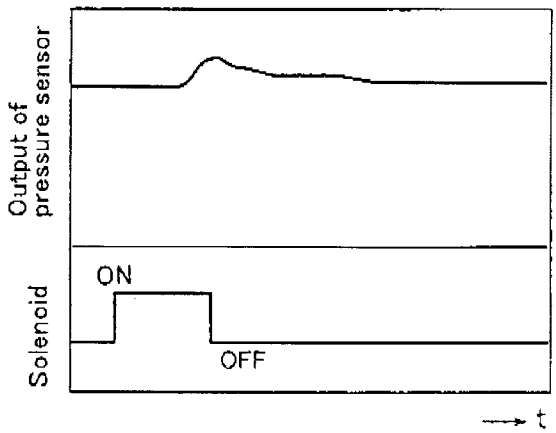

RECIPROCATING PUMP WITH MALFUNCTION DETECTING APPARATUS

BACKGROUND OF THE INVENTION

1. Technical Field of the Invention

The present invention relates to a reciprocating pump for sucking and discharging a fluid by means of a reciprocating member such as a piston, a plunger, etc., and in particular to a reciprocating pump provided with malfunction-detecting means for detecting malfunctions or abnormalities, such as sucking failure, and failure to discharge a fluid under pressure up to a destination.

2. The Related Art

An ordinary reciprocating pump to be employed for the lubrication of a small air-cooled two-stroke gasoline engine (hereinafter, referred to as an internal combustion engine) which is adapted to be employed as a power source for a portable power working machine, such as a chain saw, is constructed as shown in FIG. 11, for instance. This conventional reciprocating pump shown in FIG. 11 will be briefly explained as follows. The reciprocating pump 2 basically comprises a main body 60 in which a cylinder portion 65, provided with awl sucking port 66 and an discharging port 67 to be opened or closed by a ball valve 75, is fittingly received, a reciprocating member 70, comprising a plunger rod 71 slidably fitted in the cylinder portion 65 and a main plunger body 72 into which a rear end portion of the plunger rod 71 is press-inserted and fixed thereto, a solenoid 80 attached to one end portion (on the right side in the drawing) of the main body 60 so as to drive the reciprocating member 70, and a delivery passageway member 90 screw-engaged with the other end portion (on the left side in the drawing) of the main body 60.

The ball valve 75 is normally urged in the direction to close the discharging port 67 by means of a coil spring 74 which is interposed between the ball valve 75 and the delivery passageway member 90. On the other hand, the reciprocating member 70 is normally urged toward the right side of the drawing by means of a coil spring 78 which is interposed between the cylinder portion 65 and the main plunger body 72.

The solenoid 80 is secured between the main body 60 and a securing tube body 84 which is screw-engaged with the outer circumferential wall of one end of the main body 60. The outer circumferential wall of the securing tube body 84 is encased by a stopper cover 85 having a bottomed cylindrical configuration.

The solenoid 80 is designed to be switched ON (electrical magnetization)/OFF by way of a driving pulse to be fed thereto at a predetermined cycle from an outside power source (controlling device) (not shown). When the solenoid 80 is switched OFF from ON, the reciprocating member 70 is caused to move rightward in the drawing due to the urging force of the coil spring 78, thereby moving the plunger rod 71 in the direction to open the sucking port 66. As a result, a fluid (a lubricating oil for the internal combustion engine) is permitted to flow into a valve chamber 61 which is formed between the plunger rod 71 and the ball valve 75, and, at the same time, the rear flange portion 73 of the main plunger body 72 is contacted with the stopper cover 85 (the state indicated by a solid line in the drawing).

When the solenoid 80 is switched ON in this state, the reciprocating member 70 is caused to move leftward in the drawing due to the generation of magnetic force, thereby moving the plunger rod 71 in the direction to close the sucking port 66, and, at the same time, the fluid in the valve chamber 61 is pressed so as to push the ball valve 75 leftward in the drawing. As a result, the flange portion 73 of the main plunger body 72 contacts a plastic buffer plate 88 adhered to the right end face of the securing tube body 84.

As a result, the discharging port 67 is opened, thus permitting the fluid in the valve chamber 61 to flow toward the delivery passageway member 90.

Therefore, it is possible, through the ON/OFF operation of the solenoid 80, to enable the lubricating oil in an oil tank (not shown) to be introduced, through an oil strainer and an inlet pipe, etc. (not shown), into the valve chamber 61 from the sucking port 66. The lubricating oil thus introduced into the valve chamber 61 is then permitted to flow therefrom in a pressurized manner so as to be delivered, through the discharging port 67, the ball valve 75, a delivery passageway 92 extending through the delivery passageway member 90, a check valve 95 disposed at the delivery port of the delivery passageway 92, and an discharge pipe (not shown) coupled with the delivery passageway member 90, to the destination, i.e. the sliding portions of the internal combustion engine, etc.

The reference number 68 in FIG. 11 represents a space for introducing the power cables (not shown) for feeding a driving pulse to the solenoid 80.

If any operational abnormality occurs in the reciprocating pump described above, e.g. the sucking side of the pump is clogged, i.e. the oil (fluid) can no longer be normally sucked due to the exhaustion of oil (due to the sucking of air), or a clogging of the pipe at the discharge port is generated to thereby make it impossible to feed the oil to the destination thereof it is desirable to take any appropriate countermeasure, such as to stop the internal combustion engine to prevent seizure, or to give an alarm.

Therefore, it is conventionally considered to attach a pressure sensor to the reciprocating pump so as to detect a fluctuation of pressure at the discharge port. In this case, the aforementioned abnormality can be detected based on an output (detection signal) emitted from the pressure sensor.

More specifically, as shown in FIG. 11 for instance, a take of port 97 is installed to the delivery passageway member 90 so as to introduce, via a rigid pipe 98 for instance, a portion the oil existing at the discharge port (a delivery pressure) into a pressure sensor 100 to thereby detect a fluctuation of pressure at the discharge port.

For this purpose, a pressure sensor 100 of intermediate conversion type, which is designed to pick up all electric signal after converting the discharge pressure of oil into another kind of physical quantity (such as the magnitude of displacement) by making use of a diaphragm, etc., is generally employed. For example, a sensor wherein a strain gage is adhered onto a diaphragm, a sensor wherein a coil and a core are symmetrically arranged on both sides of a magnetic diaphragm so as to constitute an equilibrium magnetic circuit, and a sensor wherein a conductive diaphragm and an electrode are arranged to face each other so as to constitute a pair of capacitors are available in the market.

In this case, the output of the pressure sensor 100 changes synchronously with the ON/OFF operation (the discharging and sucking operation by the reciprocating member 70) of the solenoid 80 as shown in FIGS. 12(A) to 12(C). Namely, when the oil is normally supplied without any aforementioned abnormalities, the output of the pressure sensor 100 becomes wavy as shown in FIG. 12(A). When the oil is exhausted, e.g., clogging of the sucking side of the pump, the timing of discharging a change in output from that of the normal operation lags slightly behind (due to the entrainment of air) and at the same time, the amplitude of the output is slightly reduced as shown in FIG. 12(B). When the clogging of oil is caused to occur on the discharge side, the output of the pressure sensor 100 is extremely increased (becomes very high) as shown in FIG. 12(C). Therefore, it becomes possible, through the processing of the output (detected signals) of the pressure sensor 100, to detect the type of abnormality that has occurred.

The pressure sensors that are generally available in the market as mentioned above however are somewhat expensive if they are to be employed as detecting means for detecting abnormalities, such as the exhaustion of oil or the clogging of oil on the discharge side, of a reciprocating pump to be employed for the lubrication of an internal combustion engine which is designed to be employed as a power source for a portable working machine such as a chain saw. In addition to that, it is also required in the case of the aforementioned pressure sensors to introduce a fluid such as oil (a discharge pressure) directly into the pressure sensors, thereby raising a problem of the space for mounting such an introducing means. Therefore, as a matter of fact, it has been very difficult to mount any of the aforementioned pressure sensors on the reciprocating pump.

The present invention has been made with a view to overcoming the aforementioned problems. It is therefore an object of the present invention to provide a reciprocating pump, which is capable of reliably detecting abnormalities in the sucking and discharging of fluid, such as the exhaustion of oil or the clogging of oil on the discharge side, by making use of detecting means which is inexpensive and relatively simple in structure, the detection by the detecting means being enabled to execute without being unduly influenced by the bubbles included in the fluid and without allowing noise to be generated by external vibrations, thus making it possible to enhance the reliability and accuracy in the detection of abnormalities, the reciprocating pump being further featured in that it is capable of reliably preventing problems such as the leakage of fluid outside the pumping system.

BRIEF SUMMARY OF THE INVENTION

In furtherance of the aforementioned objects, the present invention provides, as a first embodiment, a reciprocating pump for sucking and discharging fluid by making use of a reciprocating member, which pump, for the purpose of detecting abnormalities, if any, in the sucking and discharging of fluid, includes an abnormality-detecting means formed of a piezoelectric element for detecting a pressure fluctuation on a discharge side of the pump.

The piezoelectric element is preferably of ring-like or cylindrical configuration and is externally fitted on an outer wall of a delivery passageway member which constitutes a fluid discharge side of the pump.

In a preferred embodiment, the reciprocating pump according to the first embodiment comprises a main body having a cylinder portion provided with an sacking port and with an discharging port to be opened or closed by a valve, a reciprocating member reciprocatively fitted in the cylinder portion to thereby enable a fluid to be sucked through the sucking port and to enable the fluid thus sucked to be discharged from the discharging port toward a delivery passageway, and a solenoid for driving the reciprocating member.

In this case, the piezoelectric element is fitted on an outer wall of a delivery passageway member and sustained between a flange portion of the delivery passageway member and the main body. Preferably, an sucking member is interposed between the piezoelectric element and the delivery passageway member and between the piezoelectric element and the main body.

The reciprocating pump according to the first embodiment of the present invention is suited for use as an oil pump wherein a fluid to be sucked and discharging is a lubricating oil for an internal combustion engine.

In another preferred version of the reciprocating pump according to the first embodiment of the present invention which is constructed as mentioned above, a single body of the piezoelectric element having a ring-like or cylindrical configuration is employed as an abnormality-detecting means for detecting abnormalities, if any, in the sucking and discharging of fluid. In a preferable embodiment, the piezoelectric element is externally fitted on an outer wall of a delivery passageway member and sustained between a flange portion of the delivery passageway member and the main body, with an sucking member being interposed between the piezoelectric element and the delivery passageway member, and between the piezoelectric element and the main body.

According to the reciprocating pump of the present invention which is constructed as mentioned above, the delivery passageway member is caused to expand or shrink, for instance, due to a fluctuation of pressure of the fluid existing on the discharge side of the fluid to be sucked and discharged by the reciprocating pump, a force resulted from the deformation of the delivery passageway member is transmitted via the insulating member to the piezoelectric element. As a result, the piezoelectric element is caused to expand or shrink, and hence the output (detected signals) from the piezoelectric element is caused to change depending on the aforementioned fluctuation of pressure.

In this case, the output from the piezoelectric element becomes essentially identical with the output of the aforementioned pressure sensor, so that when the output from the piezoelectric element is processed by means of a computer, etc, the type of the abnormality, such as the exhaustion of oil or the clogging of oil, can be automatically detected.

A piezoelectric element of ring-like or cylindrical configuration as described above is available in the market at a considerably lower price than the aforementioned conventional pressure sensor. Additionally, it is not necessary to introduce a fluid such as oil (discharge pressure) directly into the piezoelectric element. Moreover, the ring-like or cylindrical piezoelectric element can be easily fitted on the outer wall of the delivery passageway member and sustained between the delivery passageway member and the main body, thereby making it possible to extremely simplify the attachment of the piezoelectric element.

As described above, it is possible according to the first embodiment of the present invention to reliably detect abnormalities in the sucking and discharging of fluid, such as the exhaustion of oil or the clogging of oil on the discharge side, by making use of an inexpensive piezoelectric element which is also relatively simple in structure.

On the other hand, in a second embodiment of the reciprocating pump according to the present invention, the pump is constructed such that a pressure fluctuation of the fluid being discharged from the discharging port can be directly transmitted to the piezoelectric element employed as an abnormality-detecting means.

In this case, the delivery passageway member communicated with the discharging port is preferably formed into a cylindrical configuration having a passageway/pressure detecting chamber incorporated therein, and also having the piezoelectric element secured to the outer circumferential wall thereof.

In a more preferable embodiment, the reciprocating pump comprises a main body having a cylinder portion provided with an sucking port and with an discharging port the, delivery passageway member communicated via a first pressure-adjusting valve with the discharging port of the main body, a second pressure-adjusting valve disposed on a downstream side of the delivery passageway member, a reciprocating member reciprocatively fitted in the cylinder portion to thereby enable a fluid to be sucked through the sucking port and enable the fluid thus sucked to be discharged from the discharging port toward the passageway/pressure detecting chamber, and a solenoid for driving the reciprocating member, wherein the pressure adjustment valve of the second pressure-adjusting valve is set higher than the pressure adjustment valve of the first pressure-adjusting valve, and a pressure fluctuation of the fluid inside the passageway/pressure detecting chamber is enabled to be directly transmitted to the piezoelectric element.

According to this second embodiment of the reciprocating pump constructed as described above, since a pressure fluctuation of the fluid being discharged from the discharging port can be directly transmitted to the piezoelectric element, the reaction of the piezoelectric element to a pressure fluctuation of the fluid is rendered more sensitive as compared with the aforementioned first embodiment, wherein the deformation force due to the expansion and shrinkage of the delivery passageway member is designed to be transmitted to the piezoelectric element, i.e. wherein a pressure fluctuation of the fluid is indirectly transmitted to the piezoelectric element.

Further, in the previous embodiment where the piezoelectric element having a ring-like or cylindrical configuration is externally fitted on an outer wall of the delivery passageway member, there is a possibility that the fluctuation of pressure of fluid might be absorbed by a flexible hose connected with the delivery passageway member, so that the fluctuation of output of the piezoelectric element could be rather weak and small. Whereas, in this second embodiment, since the second pressure-adjusting valve is mounted on the delivery passageway member in addition to the first pressure-adjusting valve (which is generally provided as a discharge valve) so as to enable a pressure fluctuation of the fluid existing between these valves to be directly transmitted to the piezoelectric element, the sensitivity of the piezoelectric element to a pressure fluctuation of the fluid can be further enhanced.

Therefore, it is possible, according to this second embodiment, to improve the reliability and accuracy in the detection of abnormality of the pump, thus enhancing the reliability of the pump.

Furthermore, with a view to attaining the aforementioned objects, according to a third embodiment of the reciprocating pump of the present invention, an abnormality-detecting means formed of a piezoelectric element for detecting a pressure fluctuation on a discharge side of the pump is attached to the pump in order to detect any abnormality in the sucking and discharging of fluids wherein a pressure fluctuation of the fluid being discharged from the discharging port can be directly transmitted to the piezoelectric element through a pressure-receiving member made of a rigid body.

In a preferable embodiment, the delivery passageway member communicated with the discharging port is preferably formed into a cylindrical configuration having a passageway/pressure detecting chamber incorporated therein and also having the piezoelectric element secured to the outer circumferential wall thereof.

In a more preferable embodiment, an insert hole for slidably fitting the pressure-receiving member therein is formed between the passageway/pressure detecting chamber and the piezoelectric element to enable the fluctuation of pressure of fluid inside the passageway/pressure detecting chamber to be transmitted to the piezoelectric element.

The pressure-receiving member is preferably shaped into a T-shaped configuration in side view, which is constituted by a rod-like insert portion and a disc-like pushing portion.

In another preferable embodiment, a doughnut-shaped sealing member is externally inserted over the rod-like insert portion of the pressure-receiving member and positioned in contact with the disc-like pushing portion so as to seal an interface between the passageway/pressure detecting chamber and the piezoelectric element.

In another preferable embodiment, a vibration-proofing member made of rubber, etc. is interposed between the delivery passageway member and the piezoelectric element in order to prevent external vibrations from being transmitted to the piezoelectric element.

According to this third embodiment of the reciprocating pump constructed as described above, since a piezoelectric element is employed as an abnormality-detecting means for detecting any abnormality in the sucking and discharging of fluid, and a pressure fluctuation of the fluid being discharged from the discharging port is enabled to be directly transmitted to the piezoelectric element through a pressure-receiving member made of a rigid body, the piezoelectric element is caused to expand or shrink as it is directly pushed by the pressure-receiving member in conformity with the fluctuation of pressure of the fluid, thereby enabling the output of the piezoelectric element to fluctuate in conformity with the fluctuation of pressure. In this case, the output of the piezoelectric element is fundamentally the same as the output of the aforementioned conventional pressure sensor. Therefore, it becomes possible, through the processing of the output of the piezoelectric element by making use of a computer, etc., to automatically detect the type of the aforementioned abnormality, such as the exhaustion of oil or the clogging on the oil discharge side. In this case, since the piezoelectric element is available in the market at considerably low price as compared with the aforementioned pressure sensor, it is possible to reliably detect abnormalities in the sucking and discharging of fluid, such as the exhaustion of oil or the clogging of oil on the discharge side, by making use of an inexpensive and structurally simple piezoelectric element.

Additionally, since the fluctuation of pressure of fluid is transmitted to the piezoelectric element through a pressure-receiving member made of a rigid body, it is possible to greatly enhance the reliability and accuracy in the detection of abnormality as compared with those to be obtained by the reciprocating pump of the aforementioned second embodiment wherein the fluctuation of pressure of fluid is designed to be transmitted to the piezoelectric element possibly through a fluid containing air bubbles of the pressure transmitting passageway portion.

Since a vibration-proofing member made of rubber, etc. is interposed between the delivery passageway member and the piezoelectric element, external vibrations due to the reciprocative movement of the reciprocating pump (main body) or of the internal combustion engine to which the fluid (lubricating oil) is to be fed can be absorbed and alleviated by the vibration-proofing member, thus making it possible to inhibit the external vibrations from being transmitted to the piezoelectric element. As a result, it is possible to minimize the noise originating from such external vibrations, thereby making it possible, for this reason also, to enhance the reliability and accuracy in the detection of abnormality.

Additionally, since a doughnut-shaped sealing member is externally inserted over the rod-like insert portion of the pressure-receiving member and positioned in contact with the disc-like pushing portion, it is possible to prevent the sealing member from being undesirably deformed (deformation such as the narrowing of the inner diameter thereof) by the effects of the fluctuating pressure of fluid as seen in the case of the aforementioned second embodiment, thereby making it possible to prevent the leakage of fluid out of the pumping system.

BRIEF DESCRIPTION OF THE SEVERAL VIEWS OF THE DRAWING

FIGS. 2(A)–2(C) depict graphs illustrating the fluctuations of output in the normal state, as well as in an abnormal state, of the piezoelectric element employed in the reciprocating pump shown in FIG. 1;

FIGS. 6(A)–6(C) depict graphs illustrating the fluctuations of output in the normal state, as well as in an abnormal state, of the piezoelectric element employed in the reciprocating pump of the second embodiment shown in FIG. 3;

FIGS. 12(A)–12(C) depict graphs illustrating the fluctuations of output in the normal state, as well as in an abnormal state, of the piezoelectric element employed in the conventional reciprocating pump shown in FIG. 1.

DETAILED DESCRIPTION OF THE INVENTION

The embodiments of the present invention will be explained with reference to tile drawings as follows.

Figure 1:
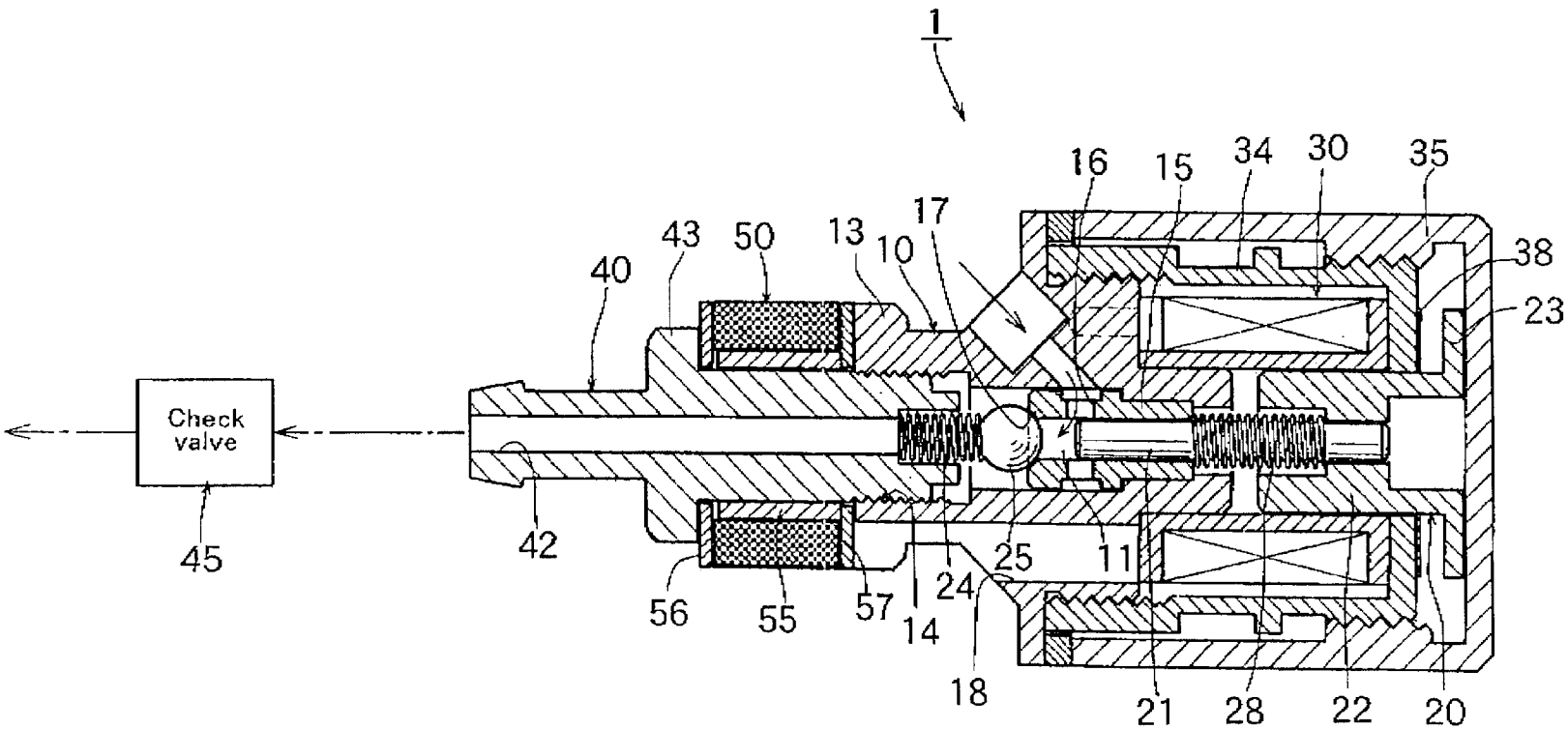
FIG. 1 is a cross-sectional view illustrating the first embodiment of the reciprocating pump according to the present invention.
Figure 11:
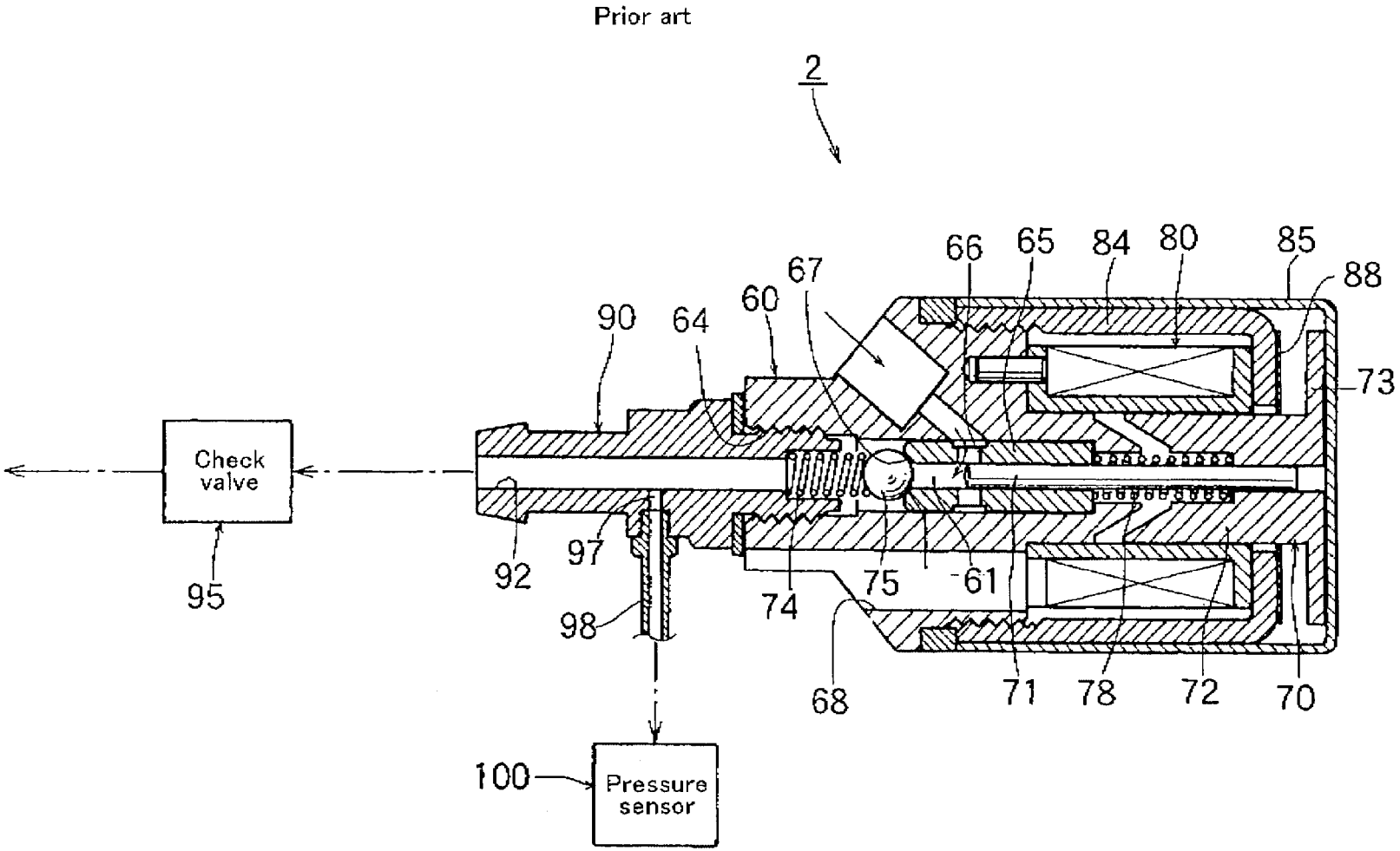
Prior art FIG.11
FIG. 11 is a cross-sectional view illustrating a reciprocating pump according to the prior art.

FIG. 1 is a cross-sectional view illustrating one embodiment of the reciprocating pump according to the present invention. The reciprocating pump 1 is adapted to be employed for the lubrication of a small air-cooled two-stroke gasoline engine (hereinafter, referred to as an internal combustion engine) which is to be employed as a power source for a portable power working machine such as a chain saw, and is constructed fundamentally in the same manner as the conventional reciprocating pump 2 as shown in FIG. 11.

Namely, the reciprocating pump 1 according to this embodiment comprises a main body 10 in which a cylinder portion 15 provided with an sucking port 16 and with an discharging port 17 to be opened or closed by a ball valve 25 is fittingly received, a reciprocating member 20, comprising a plunger rod 21 slidably fitted in the cylinder portion 15 and a main plunger body 22 into which a rear end portion of the plunger rod 21 is press-inserted and fixed thereto, a solenoid 30 attached to one end portion (on the right side in the drawing) of the main body 10 so as to drive the reciprocating member 20, and a delivery passageway member 40 screw-engaged with the other end portion (on the left side screwed portion 14 in the drawing) of the main body 10.

The ball valve 25 is normally urged in the direction to close the discharging port 17 by means of a coil spring 24 which is interposed between the ball valve 25 and the delivery passageway member 40. On the other hand, the reciprocating member 20 is normally urged toward the right side of the drawing by means of a coil spring 28 interposed between the cylinder portion 15 and the main plunger body 22.

The solenoid 30 is secured between the main body 10 and a securing tube body 34 which is screw-engaged with the outer circumferential wall of one end of the main body 10. The outer circumferential wall of the securing tube body 34 is fixingly engaged with a stopper cover 35 having a bottomed cylindrical configuration, The solenoid 30 is designed to be switched ON (electrical magnetization)/OFF by way of a driving pulse to be fed thereto at a predetermined cycle from an outside power source (controlling device) (not shown). When the solenoid 30 is switched OFF from ON, the reciprocating member 20 is caused to move rightward in the drawing due to the urging force of the coil spring 28, thereby moving the plunger rod 21 in the direction to open the sucking port 16. As a result, a fluid (a lubricating oil for the internal combustion engine) is permitted to flow into a valve chamber 11 formed between the plunger rod 21 and the ball valve 25, and, at the same time, the rear flange portion 23 of the main plunger body 22 is contacted with a stopper cover 35 (the state indicated by a solid line in the drawing).

When the solenoid 30 is switched ON in this state, the reciprocating member 20 is caused to move leftward in the drawing due to the generation of magnetic force, thereby moving the plunger rod 21 in the direction to close the sucking port 16, and at the same time, the fluid in the valve chamber 11 is pressed so as to push the ball valve 25 leftward in the drawing. As a result, the flange portion 23 of the main plunger body 22 is contacted with a plastic buffer plate 38 adhered to the right end face of the securing tube body 34.

As a result, the discharging port 17 is opened, thus permitting the fluid in the valve chamber 11 to flow toward the delivery passageway member 40.

Therefore, it is possible, through the ON/OFF operation of the solenoid 30, to enable the lubricating oil in an oil tank (not shown) to be introduced, through an oil strainer and an inlet pipe, etc. (not shown), into the valve chamber 11 from the sucking port 16. The lubricating oil thus introduced into the valve chamber 11 is then permitted to flow therefrom in a pressurized manner so as to be delivered to the destination, i.e. the sliding portions of the internal combustion engine, through a path including the discharging port 17, the ball valve 25, a delivery passageway 42 passing through the delivery passageway member 40, a check valve 45 disposed at the discharge port of the delivery passageway 42, and an discharge pipe (not shown) coupled with the delivery passageway member 40.

In addition to the aforementioned constituent components, according to this embodiment, as an abnormality-detecting means for detecting abnormalities, if any, in the sucking and discharging of lubricating oil, a cylindrical piezoelectric element 50 (which is available in the market) is fitted on the outer wall of the delivery passageway member 40 and sustained between a flange portion 43 of the delivery passageway 40 and a flange portion 13 of the main body 10. Furthermore, for the purpose of preventing the piezoelectric element 50 from being damaged in performance due to the generation of leak current, etc., a cylindrical inner insulating member 55 and disk-like insulating members 56 and 57 are respectively interposed between the piezoelectric element 50 and the delivery passageway member 40 and the main body 10.

The output (detected signals) from the piezoelectric element 50 is designed to be taken out through a lead wire (not shown) which is electrically connected with one end face of the piezoelectric element 50. The piezoelectric element 50 is preliminarily compressed between the flange portions 43 and 13 by a predetermined magnitude of pressure.

The reference number 18 in FIG. 1 represents a space for introducing the power cables (not shown) for feeding a driving pulse to the solenoid 30.

According to the reciprocating pump 1 of this first embodiment which is constructed as mentioned above, the delivery passageway member 40 is caused to expand or shrink, due for instance to a fluctuation of pressure that may be caused by the discharge of lubricating oil (when the solenoid 30 is turned ON). A force resulted from the deformation of the delivery passageway member 40 is thus transmitted via the insulating members 55, 56 and 57 to the piezoelectric element 50. As a result, the piezoelectric element 50 is caused to expand or shrinks and hence a voltage (output) proportional to the magnitude of expansion and shrinkage of the piezoelectric element 50 is generated.

In this case, in the fundamentally same manner as the output of the conventional pressure sensor 100 (FIG. 11) described previously, the output of the piezoelectric element 50 changes synchronously with the ON/OFF operation (the discharging and sucking operation by the reciprocating member 20) of the solenoid 30 as slow in FIGS. 2(A) to 2(C). Namely, when the oil is normally supplied without the aforementioned abnormalities, the output of the piezoelectric element 50 becomes wavy as shown in FIG. 2(A). When the oil is exhausted, the timing of exhibiting a change in output from that of the normal operation lags slightly behind (due to the entrainment of air) and, at the same time, the amplitude of output is slightly reduced as shown in FIG. 2(B). When the clogging of oil is caused to occur on the discharge side, the amplitude of the output of the piezoelectric element 50 is extremely increased as shown in FIG. 2(C). Therefore, it becomes possible, through the processing of the output (detected signals) of the piezoelectric element 50, by making use of a computer for instance, to automatically detect the type of the aforementioned abnormality, such as the exhaustion of oil or the clogging on the oil discharge side.

A piezoelectric element 50 of cylindrical configuration is available in the market at a considerably lower price than the aforementioned conventional pressure sensor. Additionally, it is no longer required to introduce a fluid such as oil (a discharge pressure) directly into the piezoelectric element 50. Moreover, the ring-like or cylindrical piezoelectric element can be easily fitted on the outer wall of the delivery passageway member 40 and sustained between the delivery passageway member 40 and the main body 10, thereby making it possible to extremely simplify the attachment of the piezoelectric element 50.

Figure 3:
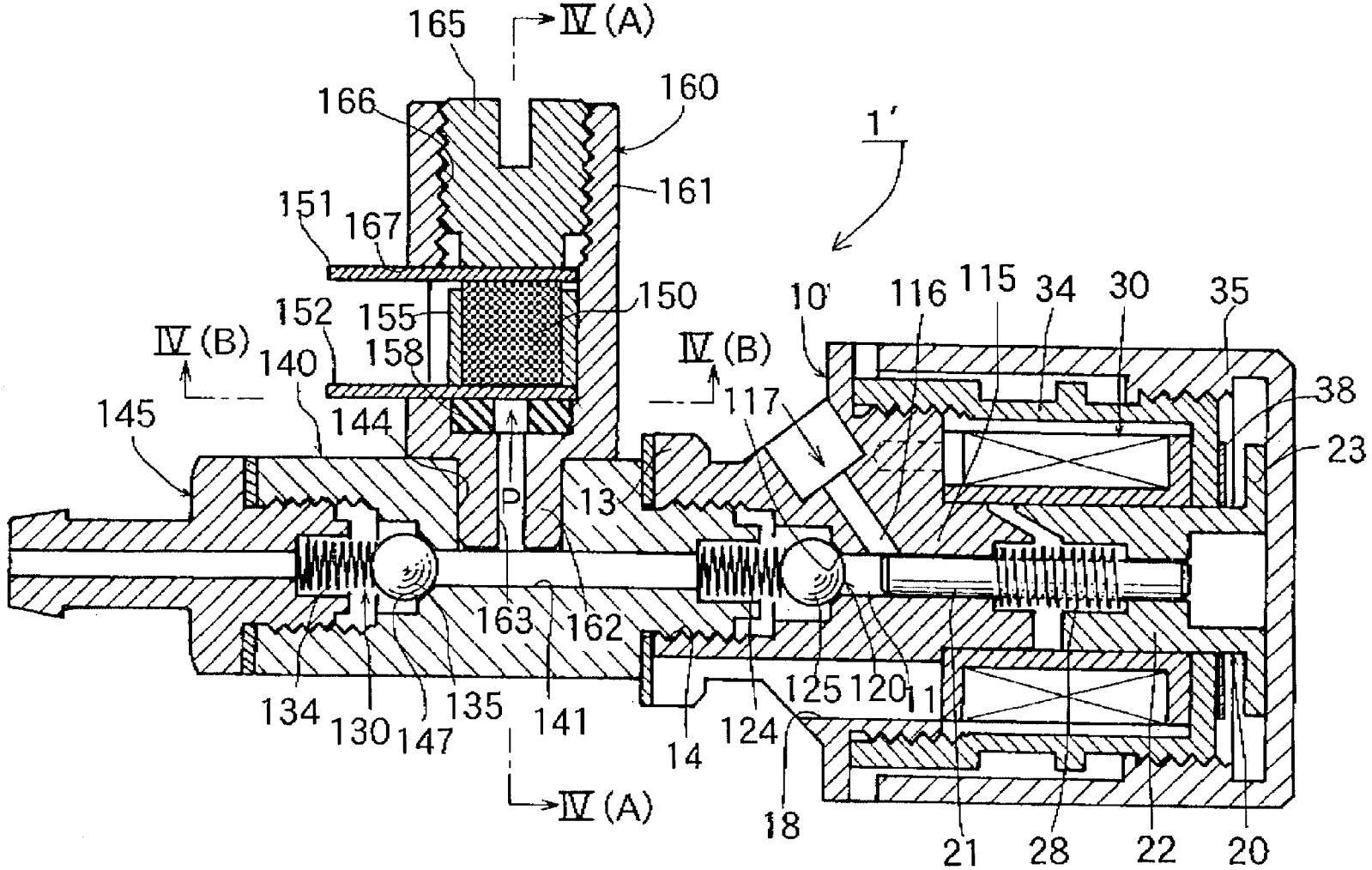
FIG. 3 is a cross-sectional view illustrating the second embodiment of the reciprocating pump according to the present invention.

As described above, it is possible according to the reciprocating pump 1 of this first embodiment to reliably detect abnormalities in the sucking and discharging of fluid, such as the exhaustion of oil or the clogging of oil on the discharge side, by making use of an inexpensive piezoelectric element which can be also constructed in a simple manner FIG. 3 shows a cross-sectional view illustrating the second embodiment of the reciprocating pump. The reciprocating pump 1' shown in FIG. 3 is constructed fundamentally in the same manner as the reciprocating pump 1 of the first embodiment shown in FIG. 1, so that the same parts or members as those of the first embodiment will be identified by the same, reference numerals to thereby omit the duplication of explanation, and the features of the second embodiment which differ from the first embodiment will be chiefly explained below The reciprocating pump 1' according to the second embodiment is constructed such that a pressure fluctuation of the fluid being discharged from an discharging port 117 can be directly transmitted to a piezoelectric element 150 employed as an abnormality-detecting means. In this case, a delivery passageway member 140 which is communicated with the discharging port 117 is formed into a cylindrical configuration having a passageway/pressure detecting chamber 141 incorporated therein and also having a piezoelectric element 150 secured to the outer circumferential wall thereof More specifically, the reciprocating pump 1' comprises a main body 10' having a cylinder portion 115 provided with an sucking port 116 and an discharging port 117, the delivery passageway member 140 communicated via a first pressure-adjusting valve 120 with the discharging port 117 of the main body 10', a second pressure-adjusting valve 130 disposed on a downstream side of the delivery passageway member 140, a reciprocating member 20 reciprocatively fitted in the cylinder portion 115, to thereby enable a fluid to be sucked through the sucking port 116 and to enable the fluid thus sucked to be discharged from the discharging port 117 toward the passageway/pressure detecting chamber 141, and a solenoid 30 for driving the reciprocating member 20.

The first pressure-adjusting valve 120 is of the kind that is usually provided as a discharge valve in a pump, and is constituted by a ball valve 125 and a compression coil spring 124 for urging the ball valve 125 in the closing direction. The second pressure-adjusting valve 130 is newly provided according to the present invention, and is constituted by a ball valve 135 for opening or closing a second discharging port disposed at an downstream end of the passageway/ pressure detecting chamber 141 and a compression coil spring 134 for urging the hall valve 135 in the closing direction. The downstream end of the delivery passageway member 140 is screw-engaged with a coupling member 145 for connecting it with a hose and the like. It is made possible to adjust the magnitude of compression of the compression coil spring 134 by adjusting the length of screw-engagement, thereby making it possible to set the pressure adjustment valve of the second pressure-adjusting valve 130.

In this embodiment, the pressure adjustment valve of the second pressure-adjusting valve 130 is set higher than the pressure adjustment valve of the first pressure-adjusting valve 120. In other words, the pressure for opening the second discharging port 147 by means of the second pressure-adjusting valve 130 is set higher than the pressure for opening the discharging port 117 by means of the first pressure-adjusting valve 120.

Figure 4:
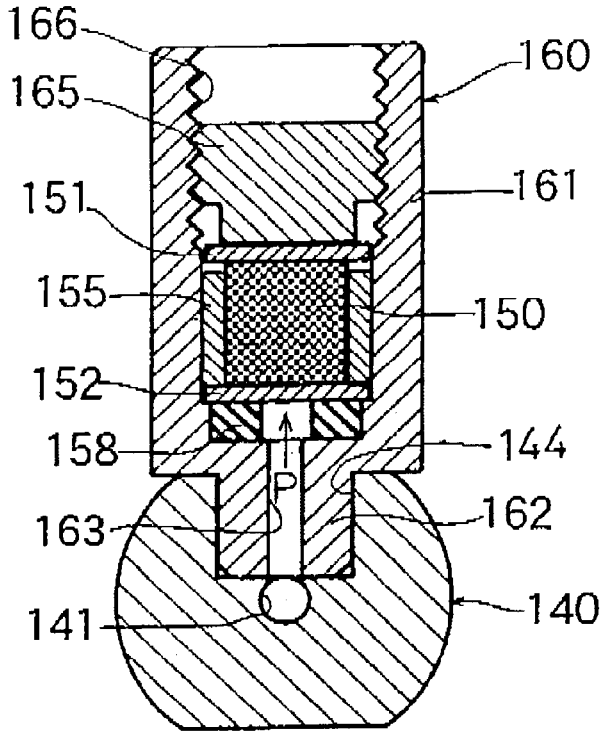
FIG. 4(A) is a cross-sectional view taken along the line IV(A)—IV(A) of FIG. 3, looking in the direction of the arrows.
FIG. 4(B) is a cross-sectional view taken along the line IV(B)—IV(B) of FIG. 3, looking in the direction of the arrows.
Figure 4:
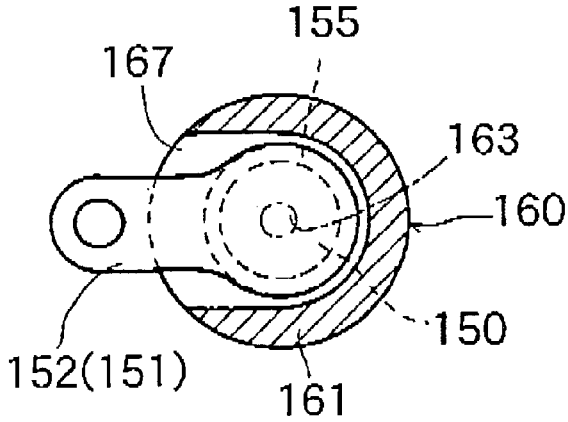
Figure 5:
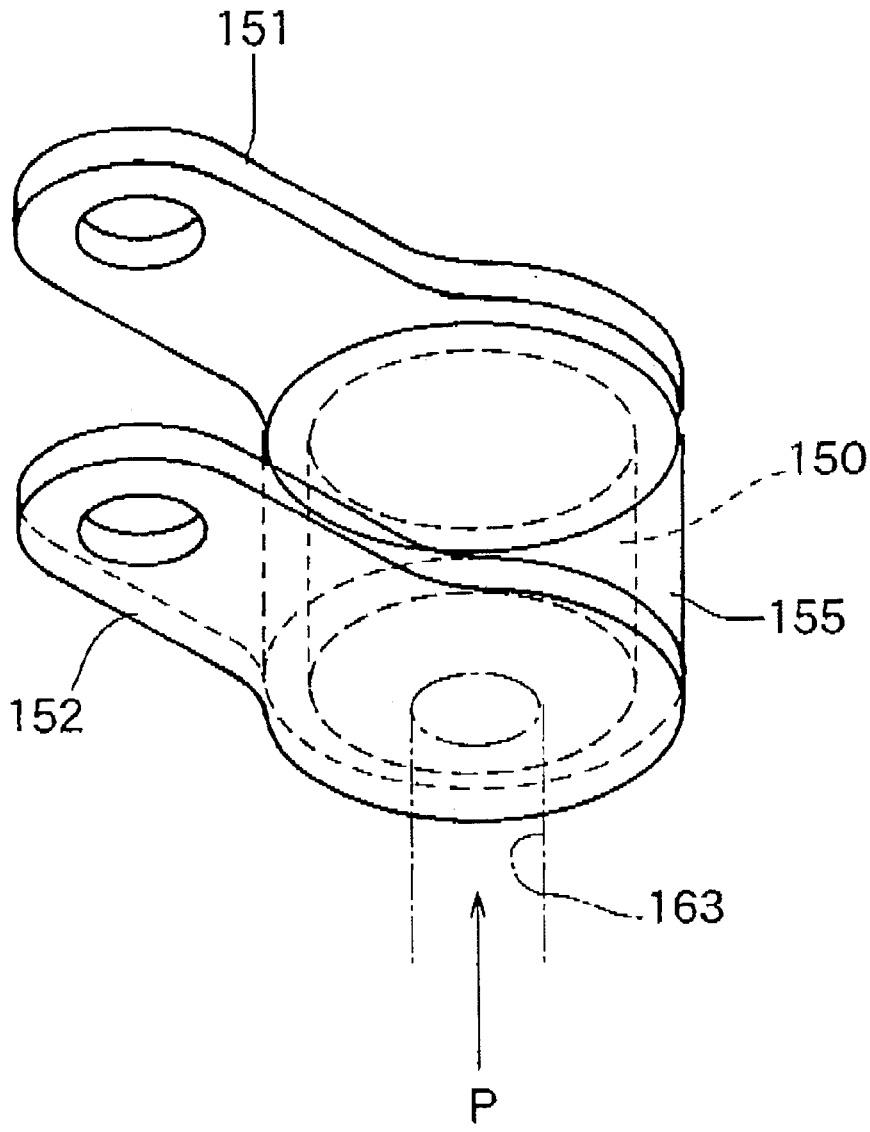
FIG. 5 is a perspective view of a piezoelectric element unit employed in the reciprocating pump shown in FIG. 3.

The outer circumferential wall of the delivery passageway member 140 is configured in cross-section in such a manner that the both surfaces thereof are chamfered parallel with each other and such that it is provided at a central surface portion thereof with an insert hole 144, into which the insert portion 162 of the holder 160 for holding the piezoelectric element 150 is press-inserted so as to be strongly held therein as shown in FIG. 4(A). The holder 160 is constituted by a cylindrical holding portion 161 and the aforementioned insert portion 162, the cylindrical holding portion 161 being provided at a lower portion thereof with a piezoelectric element-mounting port 167 directed perpendicular to the longitudinal direction of the holder 160 (FIG. 3). Thus, the piezoelectric element 150 is adapted to be fixingly attached to a lower portion of the cylindrical holding portion 161. The piezoelectric element 150 is formed of a solid columnar body, and, as clearly seen in FIGS. 4(A), 4(B) and FIG. 5, is loosely fitted in an insulating cylinder body 155 having a lower height or shorter length as compared with that of the piezoelectric element 150. Further, electrode plates 151 and 152, each having a spatulate configuration, are adhered onto the top and bottom end faces of the piezoelectric element 150, respectively.

A doughnut-shaped rubber sealing member 158 is interposed between the bottom of the cylindrical holding portion 161 (the insert portion 162) and the piezoelectric element 150 (the lower electrode plate 152). The insert portion 162 is provided, along the entire axial length thereof, with a pressure-transmitting passageway 163 for transmitting a fluctuation of pressure of fluid in the passageway/pressure detecting chamber 141 to the piezoelectric element 150.

The piezoelectric element 150 is preliminarily pressed onto the sealing member 158 at a predetermined pressure by a pressing nut 165 which is screw-engaged with an internal thread portion 166 formed at an upper portion of the cylindrical holding portion 161.

In the reciprocating pump 1' of the second embodiment also, the discharging operation of fluid is performed in the same manner as in the reciprocating pump of the second embodiment. However, according to the second embodiment of the reciprocating pump constructed as described above, since a fluctuation of pressure P of the fluid being discharged from the discharging port 117 can be directly transmitted to the piezoelectric element 150 front the passageway/pressure detecting chamber 141 through the pressure-transmitting passageway 163 of the insert portion 162, the reaction of the piezoelectric element 150 to a pressure fluctuation of the fluid is rendered more sensitive as compared with the aforementioned first embodiment wherein the deformation force due to the expansion and shrinkage of the delivery passageway member 40 is designed to be transmitted to the piezoelectric element 50, i.e. wherein a pressure fluctuation of the fluid is indirectly transmitted to the piezoelectric element 50.

Further, there is a possibility in the first embodiment that the fluctuation of pressure of fluid could be absorbed by a flexible hose to be connected with the delivery passageway member 40, so that the fluctuation of output of the piezoelectric element 50 is rather weak and small. Whereas in the second embodiment, since the second pressure-adjusting valve 130 is mounted on the delivery passageway member 140 in addition to the first pressure-adjusting valve 120 (which is generally provided as a discharge valve) so as to enable a pressure fluctuation of the fluid existing between these valves to be directly transmitted to the piezoelectric element 150, the sensitivity of the piezoelectric element 150 to a pressure fluctuation of the fluid can be further enhanced.

Therefore, as shown in FIGS. 6(A) to 6(C), it is possible, according to the reciprocating pump 1' of the second embodiment, to render the output waveforms of the piezoelectric element 150 to fluctuate more prominently on the occasions of the interruption of the normal supply of oil (FIG. 6(A)), i.e., the exhaustion of oil (FIG. 6(B)) and the clogging of oil (FIG. 2(C)). Consequently, the identification of the output waveforms of the piezoelectric element 150 can be further enhanced as compared with the first embodiment. As a result, it is possible, according to the second embodiment, to improve the reliability and accuracy in the detection of abnormality of the pump, thus enhancing the reliability of the pump.

Figure 7:
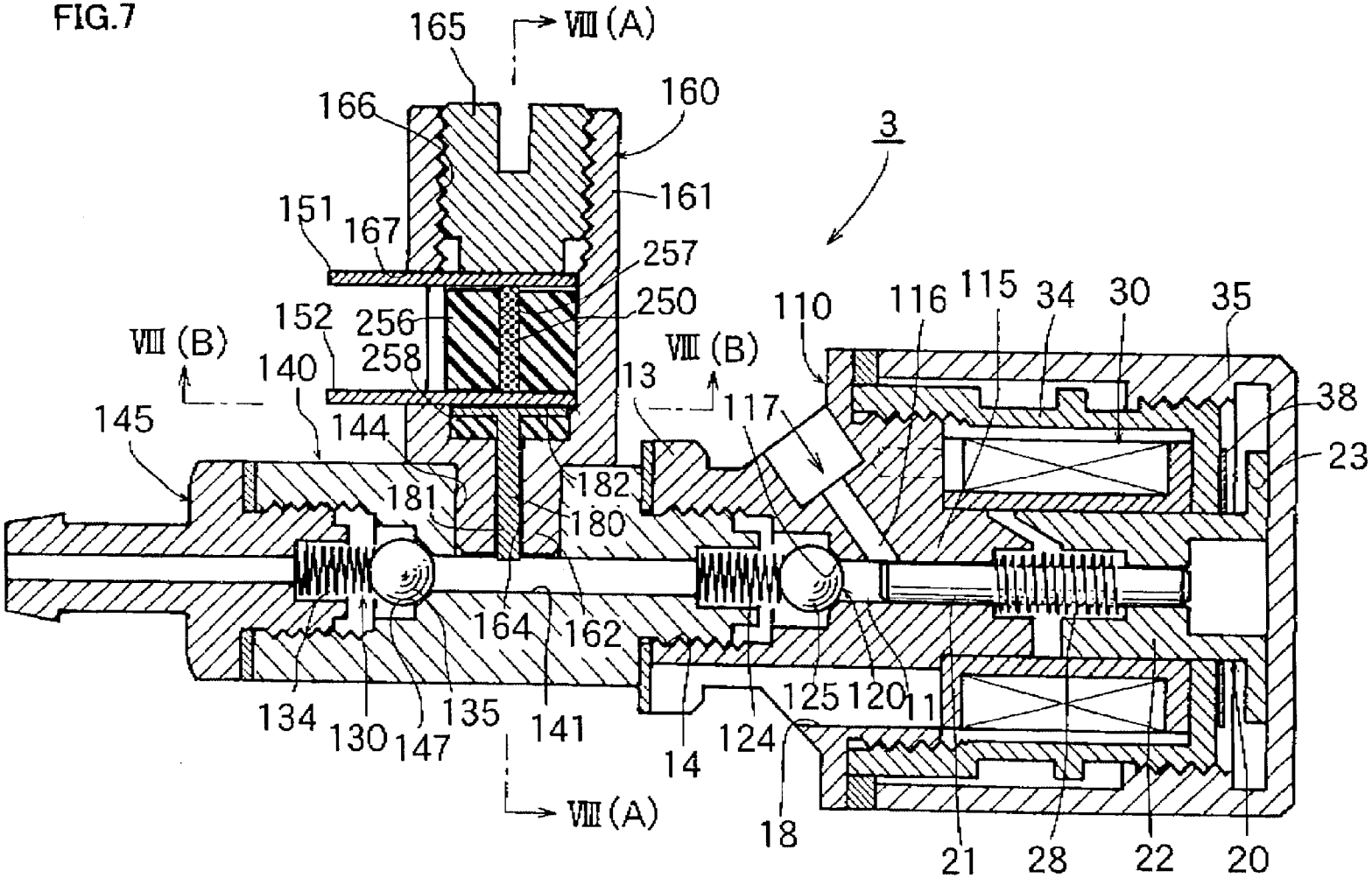
FIG. 7 is a cross-sectional view illustrating the third embodiment of the reciprocating pump according to the present invention.

FIG. 7 shows a cross-sectional view illustrating the third embodiment of the reciprocating pump. The reciprocating pup 3 shown in FIG. 7 is constructed fundamentally in the same manner as the reciprocating pump 1' of the second embodiment shown in FIG. 3, so that the same parts or members as those of the first embodiment will be identified by the same reference numerals to thereby omit the duplication of explanation, and the features of the third embodiment which differ from the second embodiment will be chiefly explained below.

In the reciprocating pump 3 according to the third embodiment, a pressure fluctuation of the fluid being discharged from the discharging port 117 is designed to be directly transmitted to the piezoelectric element 250 acting as an abnormality-detecting means through a pressures receiving member 180 made of a rigid body (metal or ceramics). Further, the delivery passageway member 140 communicated with the discharging port 117 is formed into a cylindrical configuration having a passageway/pressure detecting chamber 141 passing therethrough and also having the piezoelectric element 250 secured to the outer circumferential wall thereof.

Figure 8:
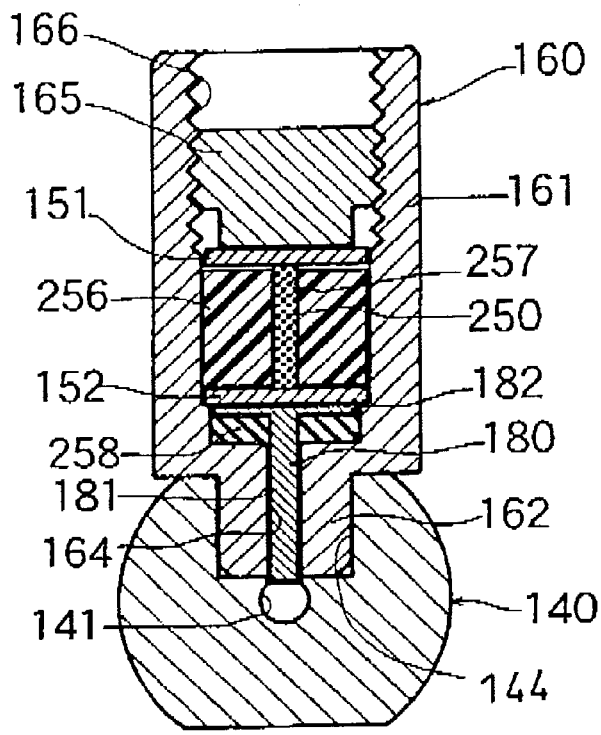
FIG. 8(A) is a cross-sectional view taken along the line VIII(A)–VIII(A) of FIG. 7, looking in the direction of the arrows.
FIG. 8(B) is a cross-sectional view taken along the line VIII(B)–VIII(B) of FIG. 7, looking in the direction of the arrows.
Figure 8:
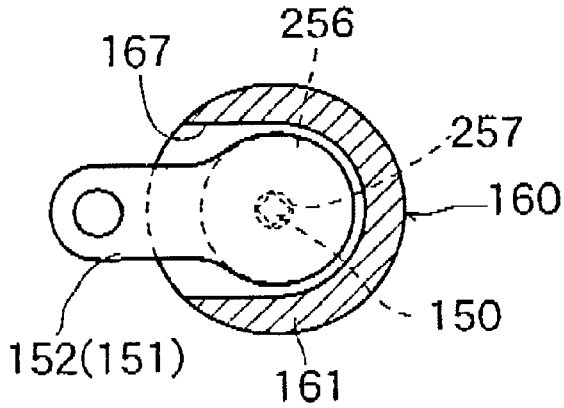
Figure 9:
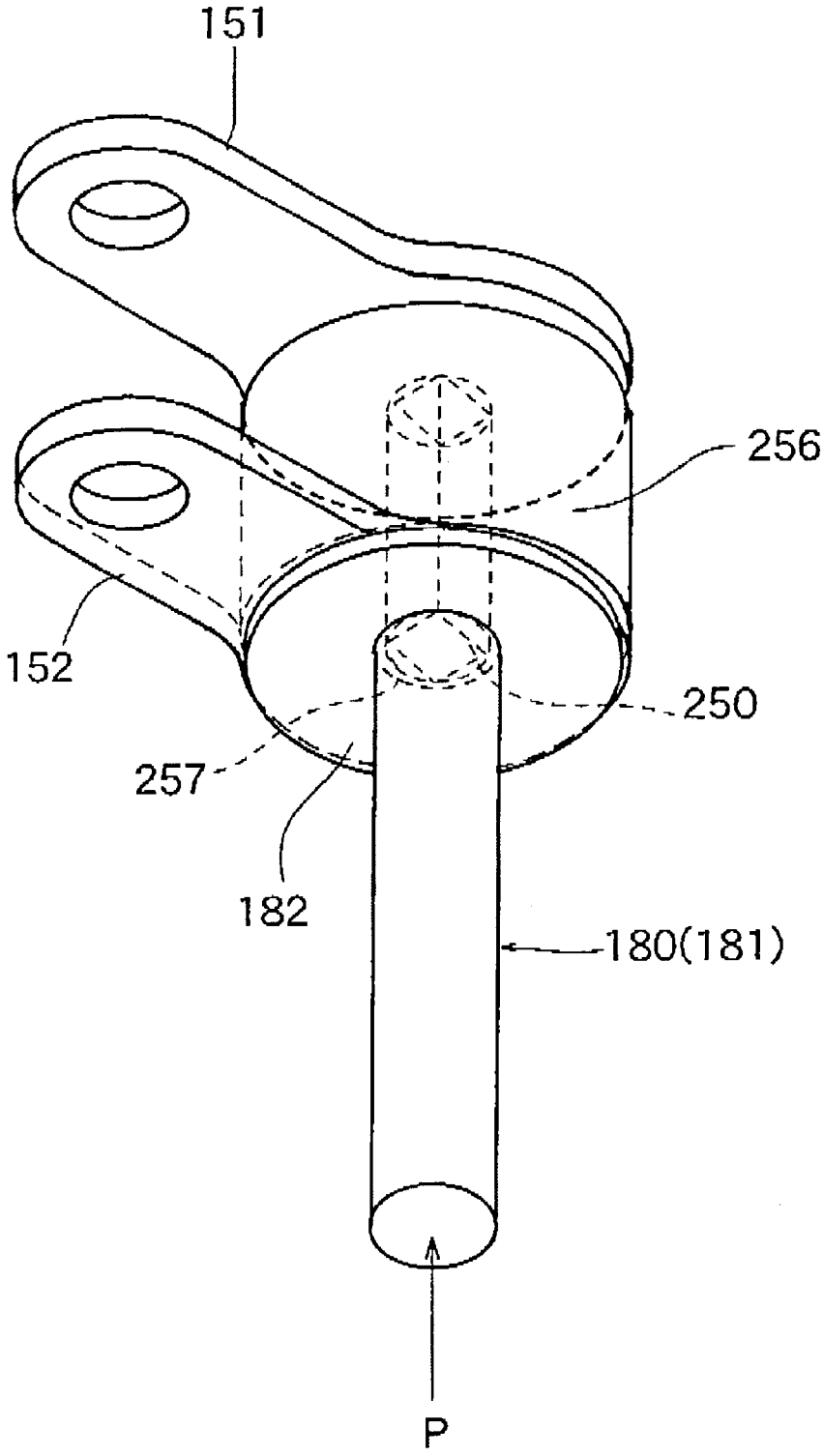
FIG. 9 is a perspective view of a piezoelectric element unit employed in the reciprocating pump according to the third embodiment shown in FIG. 7.

Further, as shown in FIG. 8(A), the outer circumferential wall of the delivery passageway member 140 is configured in cross-section in such a manner that the both surfaces thereof are chamfered parallel with each other and such that it is provided at a central surface portion thereof with an insert hole 144, into which the insert portion 162 of a holder case 160 for the piezoelectric element 250 is press-inserted so as to be strongly held therein. The holder case 160 is constituted by a cylindrical holding portion 161 and the aforementioned insert portion 162, the cylindrical holding portion 161 being provided at a lower portion thereof with a piezoelectric element-mounting port 167 directed perpendicular to the longitudinal direction of the holder case 160. Thus, the piezoelectric element 250 is secured to the lower portion of the cylindrical holding portion 161 in such a manner that the piezoelectric element 250 is slidably inserted into the central hole 257 of a cylindrical insulating holder 256 made of a synthetic resin. The piezoelectric element 250 is formed of a square bar having a square cross-section, and, as clearly seen from FIGS. 8(A), 8(B) and FIG. 9, is loosely fitted in the cylindrical insulating holder 256 having a slightly lower height or shorter length as compared with that of the piezoelectric element 250. Further, electrode plates 151 and 152, each having a spatulate configuration, are adhered onto the top and bottom end faces of the piezoelectric element 250, respectively.

The insert portion 162 constituting the bottom of the cylindrical holding portion 161 is provided, along the entire axial length thereof, with an insert hole 164, in which the pressure-receiving member 180 (or a rod-like insert portion 181 thereof) is slidably inserted for transmitting a pressure fluctuation of fluid in the passageway/pressure detecting chamber 141 to the piezoelectric element 250.

The pressure-receiving member 180 is made of a metallic rigid body and shaped into a T-shaped configuration in side view, which is constituted by the rod-like insert portion 181 and a disc-like pushing portion 192. A lower end portion of the rod-like insert portion 181 is extended into the passageway/pressure detecting chamber 141. Therefore, the pressure-receiving member 180 is adapted to directly receive the pressure of the fluid in the passageway/pressure detecting chamber 141 so as to be pushed up in the direction to push the piezoelectric element 250 (the lower electrode 152).

A doughnut-shaped rubber sealing member 258 is interposed between the bottom of the cylindrical holding portion 161 (the insert portion 162) and the piezoelectric element 250 (the lower electrode plate 152) in such a manner that the scaling member 258 is externally inserted over the rod-like insert portion 181 of the pressure-receiving member 180 and such that the top and bottom surfaces of the sealing member 258 are closely contacted with the disc-like pushing portion 182 and the cylindrical holding portion 161 (or the bottom thereof), respectively.

This piezoelectric element 250 is preliminarily pressed onto the sealing member 258 at a predetermined pressure by a pressing screw member 165 which is screw-engaged with an internal thread portion 166 formed at all upper portion of the cylindrical holding portion 161.

In the reciprocating pump 3 of the third embodiment constructed as explained above, the piezoelectric element 250 is employed as malfunction-detecting means for detecting malfunctions in the sucking and discharging of fluid, wherein the fluctuation of pressure of the fluid being discharged from the discharging port 117 is directly transmitted to the piezoelectric element 250 through the pressure-receiving member 180, which is made of a rigid body, so that the piezoelectric element 250 is enabled to be directly pressed by the pressure-receiving member 180 in conformity with the fluctuation of pressure of fluid. The piezoelectric element 250 is thereby caused to expand or shrink, so as to enable the output thereof to fluctuate in conformity with the aforementioned fluctuation of pressure. In this case, the output of the piezoelectric element 200 would become fundamentally the same as that to be obtained where a conventional pressure sensor is employed. Therefore, it becomes possible, through the processing of the output of the piezoelectric element by making use of a computer, etc., to automatically detect the type of the aforementioned abnormality, such as the exhaustion of oil or the clogging on the oil discharge side.

In this case, since the piezoelectric element 250 is available in the market at a considerably lower price than the conventional pressure sensor, it is possible to reliably detect malfunctions or abnormalities in the sucking and discharging of fluid, such as the exhaustion of oil or the clogging of oil on the discharge side, by making use of an inexpensive and structurally simple piezoelectric element.

Additionally, since the fluctuation of pressure of the fluid is enabled to be directly transmitted to the piezoelectric element 250 through a pressure-receiving member 180 made of a rigid body, it is possible to greatly enhance the reliability and accuracy in the detection of abnormality as compared with that to be obtained by the reciprocating pump of the aforementioned second embodiment, wherein the fluctuation of pressure of the fluid is designed to be transmitted to the piezoelectric element through a fluid possibly containing air bubbles of the pressure transmitting passageway portion.

Moreover, since the doughnut-shaped rubber sealing member 258 is externally inserted over the rod-like insert portion 181 of the pressure-receiving member 180 and closely contacted with the disc-like pushing portion 182 so as to seal the interface between the passageway/pressure detecting chamber 141 and the piezoelectric element 250, it is possible to prevent the sealing member from being undesirably deformed (deformation such as the narrowing of the inner diameter of sealing member) due to a fluctuation of pressure of fluid as in the case of the reciprocating pump of the second embodiment. As a result, it is possible to reliably prevent the fluid from being leaked out of the pumping system.

Figure 10:
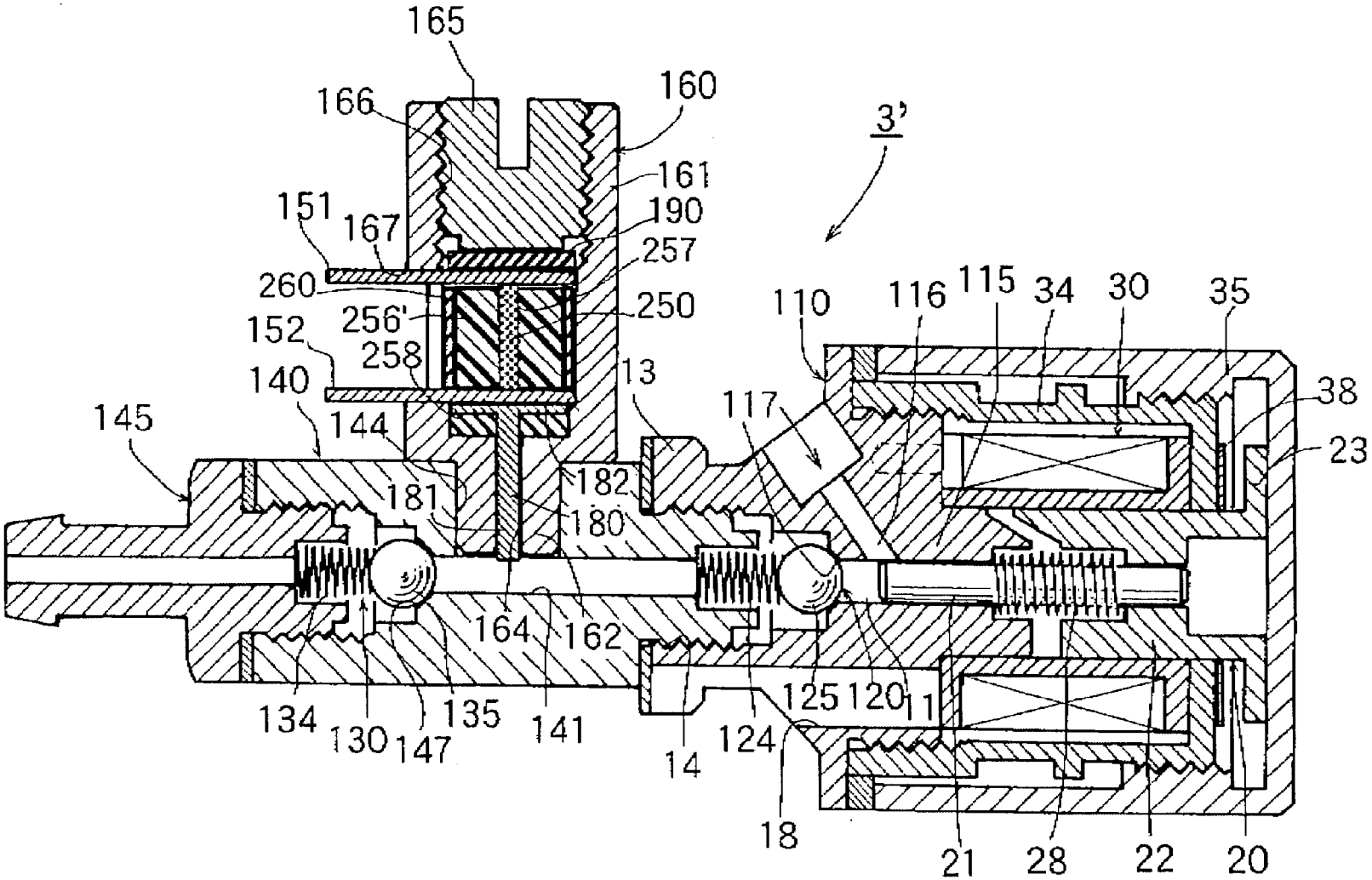
FIG. 10 is a cross-sectional view illustrating the fourth embodiment of the reciprocating pump according to the present invention.

FIG. 10 shows a cross-sectional view illustrating the fourth embodiment of the reciprocating pump. The reciprocating pump 3' shown in FIG. 10 is constructed fundamentally in the same manner as the reciprocating pump 3 of the third embodiment shown in FIG. 7, so that the same parts or members as those of the third embodiment will be identified by the same reference numerals to thereby omit the duplication of explanation, and the features of the fourth embodiment which differ from the third embodiment will be chiefly explained below.

In the reciprocating pump 3' according to the fourth embodiment, a pressure fluctuation of the fluid being discharged from the discharging port 117 is designed to be directly transmitted to the piezoelectric element 250 acting as an abnormality-detecting means through a pressure-receiving member 180 made of a rigid body as in the case of the third embodiment. In addition, the reciprocating pump 3' according to the fourth embodiment includes vibration-proofing members 190, 260 and 258, each made of rubber, etc., interposed between the delivery passageway member 140 and the screw member 165, on the one hand, and the piezoelectric element 250, on the other hand, in order to prevent external vibrations originating from the reciprocative movement of the reciprocating pump (main body) 3, or of the internal combustion engine to which the fluid (lubricating oil) is to be fed from being transmitted to the piezoelectric element 250.

More specifically, a plate-like vibration-proofing member 190 is interposed between the pressing screw member 165 and the upper electrode 151 of the piezoelectric element 250, a cylindrical vibration-proofing member 260 is externally inserted over the outer circumferential wall of an insulating holder 256' into which the piezoelectric element 250 is inserted, and the aforementioned sealing member 258 functions also as a vibration-proofing member.

Since the vibration-proofing members 190, 260 and 258, each made of rubber, etc, are. interposed between the delivery passageway member 140 screw member 165 and the piezoelectric element 250 in this manner, external vibrations due to the reciprocative movement of the reciprocating pump (main body) 3' or of the internal combustion engine to which the fluid (lubricating oil) is to be fed can be absorbed and alleviated by these vibration-proofing members 190, 260 and 258, thus making it possible to inhibit the external vibrations from being transmitted to the piezoelectric element 250. As a result; it is possible to minimize the noise originating from such external vibrations, thereby making it possible, for this reason also, to enhance the reliability and accuracy in the detection of abnormality.

Although preferable embodiments of the present invention have been explained in the foregoing explanation, it should be understood that the present invention is not limited to these embodiments, but call be varied without departing from the spirit and scope of the invention set forth in the accompanying claims.

For example, according to the aforementioned first embodiment, the cylindrical piezoelectric element 50 is externally inserted over the outer wall of the delivery passageway member 40. However, the present invention should not be construed to be limited by such a construction. For example, a pressure sensor formed of a piezoelectric element (i.e. a piezoelectric sensor) may be substituted for the pressure sensor 100 (where a diaphragm is employed for instance) in the conventional reciprocating pump 2 show in FIG. 11. In this case, the resultant structure becomes similar to that set forth as the second embodiment of the present invention, thus resulting in the saving of manufacturing cost as compared with the case where the aforementioned pressure sensor 100 is employed.

As seen from the above explanation, it is now possible according to the present invention to provide a reciprocating pump, that is capable of reliably detecting abnormalities in the sucking and discharging of fluid, such as the exhaustion of oil or the clogging of oil on the discharge side, by making use of a piezoelectric element that is inexpensive and relatively simple in stricture.

Furthermore, it is now possible to provide a reciprocating pump wherein the detection of malfunction can be executed without being detrimentally influenced by the bubbles that may be included in the fluid, while at the same tine making it possible to minimize the noise generated by the external vibrations. It is thus possible to enhance the reliability and accuracy in the detection of abnormalities and to reliably prevent problems such as the leakage of fluid outside the plumping system.

What is claimed is:

1. In a reciprocating pump wherein the inhaling and exhaling of a fluid are effected by making use of a reciprocating member and including malfunction-detecting means attached to the pump for the purpose of detecting abnormalities in the inhaling and exhaling of said fluid, the improvement wherein said malfunction-detecting means comprises a piezoelectric element for detecting a pressure fluctuation on a delivery side of the pump and wherein said reciprocating pump comprises a main body having a cylinder portion provided with an inhaling port and an exhaling port, a delivery passageway member communicated via a first pressure-adjusting valve with the exhaling port of the main body, a second pressure-adjusting valve disposed on a downstream side of the delivery passageway member, the reciprocating member reciprocatively fitted in the cylinder portion to thereby enable a fluid to be inhaled through said inhaling port and the fluid thus inhaled to be exhaled from said exhaling port to a pressure detecting chamber, and a solenoid for driving the reciprocating member, wherein the pressure adjustment value of the second pressure-adjusting valve is set higher than the pressure adjustment value of the first pressure-adjusting valve, and a pressure fluctuation of the fluid inside the pressure detecting chamber is directly transmitted to the piezoelectric element.

2. In a reciprocating pump which is provided with malfunction-detecting means for detecting a pressure fluctuation on a delivery side of the pump for finding abnormalities in the inhaling and/or exhaling of fluid, the improvement wherein said malfunction-detecting means comprises a piezoelectric element arranged such that a pressure fluctuation of the fluid being ejected from an exhaling port of the pump is directly transmitted to the piezoelectric element through a pressure-receiving member made of a rigid body and wherein said reciprocating pump comprises a main body having a cylinder portion provided with an inhaling port and with a said exhaling port, a delivery passageway member communicating via a first pressure-adjusting valve with the exhaling port of the main body, a second pressure-adjusting valve disposed on a downstream side of the delivery passageway member, a reciprocating member reciprocatively fitted in the cylinder portion to thereby enable a fluid to be inhaled through said inhaling port and enable the fluid thus inhaled to be exhaled from said exhaling port to a pressure detecting chamber, and a solenoid for driving the reciprocating member, wherein the pressure adjustment value of the second pressure-adjusting valve is set higher than the pressure adjustment value of the first pressure-adjusting valve, and a pressure fluctuation of the fluid inside the pressure detecting chamber is directly transmitted, via said pressure-receiving member, to the piezoelectric element.

3. The reciprocating pump according to claim 2, wherein an insert hole for slide-fitting the pressure-receiving member therein is formed between the pressure detecting chamber and the piezoelectric element to thereby enable the fluctuation of pressure of fluid inside the pressure detecting chamber to be transmitted to the piezoelectric element.

4. The reciprocating pump according to claim 3, wherein said pressure-receiving member is shaped into a T-shaped configuration in side view, which is constituted by a rod-shaped insert portion and a disc-shaped pushing portion.

5. The reciprocating pump according to claim 4, wherein a doughnut-shaped sealing member is externally inserted over the rod-shaped insert portion of the pressure-receiving member and positioned in contact with the disc-shaped pushing portion to thereby seal an interface between the pressure detecting chamber and the piezoelectric element.

6. The reciprocating pump according to claim 2, wherein rubber vibration-proofing members are interposed between the delivery passageway member and the piezoelectric element in order to prevent external vibrations from being transmitted to the piezoelectric element.

7. The reciprocating pump according to claim 1, wherein the pressure fluctuation of the fluid being ejected from the exhaling port is directly transmitted to the piezoelectric element employed as an abnormality-detecting means.

8. The reciprocating pump according to claim 1, wherein said delivery passageway member communicating with the exhaling port is formed into a cylindrical configuration having a pressure detecting chamber passing therethrough and also having the piezoelectric element secured to the outer circumferential wall thereof.

9. The reciprocating pump according to claim 2, wherein a delivery passageway member communicates with the exhaling port and has a cylindrical configuration having a pressure detecting chamber passing therethrough and also having the piezoelectric element secured to the outer circumferential wall thereof.

* * * * *